US009482038B2

(12) United States Patent
Barker et al.

(10) Patent No.: US 9,482,038 B2
(45) Date of Patent: Nov. 1, 2016

(54) LATCH SPACER

(71) Applicant: Schlage Lock Company LLC, Indianapolis, IN (US)

(72) Inventors: Kenton Hayes Barker, Colorado Springs, CO (US); Peter Malenkovic, Monument, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 127 days.

(21) Appl. No.: 14/265,111

(22) Filed: Apr. 29, 2014

(65) Prior Publication Data

US 2014/0319855 A1 Oct. 30, 2014

Related U.S. Application Data

(60) Provisional application No. 61/817,279, filed on Apr. 29, 2013.

(51) Int. Cl.

| | |
|---|---|
| ***E05B 9/00*** | (2006.01) |
| ***E05C 1/16*** | (2006.01) |
| ***E05B 9/08*** | (2006.01) |
| *E05B 15/00* | (2006.01) |

(52) U.S. Cl.

CPC ..... *E05C 1/163* (2013.01); *E05B 9/08* (2013.01); *E05B 15/0053* (2013.01); *Y10T 292/62* (2015.04)

(58) Field of Classification Search

CPC ..... Y10T 292/62; Y10T 70/8459; Y10T 70/7915; Y10T 292/79; Y10T 70/8973; E05B 63/06

USPC ..... 292/337, 346, DIG. 51, DIG. 53

See application file for complete search history.

(56) References Cited

U.S. PATENT DOCUMENTS

| | | | | |
|---|---|---|---|---|
| 1,981,289 | A | 11/1934 | Schlage | |
| 2,004,510 | A | 6/1935 | Sohlage | |
| 2,091,248 | A | 8/1937 | Schlage | |
| RE21,024 | E | 3/1939 | Schlage | |
| RE21,025 | E | 3/1939 | Schlage | |
| 2,327,070 | A * | 8/1943 | Schlage | E05B 9/002 292/337 |
| 2,779,186 | A | 1/1957 | Grevengoed | |
| 2,940,293 | A | 6/1960 | Schlage | |
| 3,039,291 | A | 6/1962 | Dusing | |
| 3,633,312 | A | 1/1972 | Yeager | |
| 4,372,594 | A * | 2/1983 | Gater | E05B 63/06 292/1.5 |
| 4,407,537 | A | 10/1983 | Ames | |
| 4,854,620 | A | 8/1989 | Dunphy | |
| 4,950,269 | A * | 8/1990 | Gaines, Jr. | A61B 17/7004 606/261 |
| 6,318,026 | B1 | 11/2001 | Ayres | |

* cited by examiner

*Primary Examiner* — Mark Williams

(74) *Attorney, Agent, or Firm* — Taft Stettinius & Hollister LLP

(57) ABSTRACT

A latch spacer for securing a latch assembly in a hollow inner region of a door. The latch spacer includes a plurality of sidewalls. At least a portion of the sidewalk abut against inner surfaces of the sidewalls of the door to provide a friction fit that secures the latch spacer within the inner region. The latch spacer also includes an inner wall that generally defines an opening that is adapted to receive placement of at least a portion of a latch housing. The latch spacer may include at least one crush rib that extends from the sidewalls of the latch spacer. The latch spacer may be arranged in a plurality of orientations to accommodate various door thicknesses. Additionally, portions of the latch spacer may be configured to bend or flex slightly to assist in the latch spacer being able to adjust to different door thicknesses.

20 Claims, 6 Drawing Sheets

LATCH SPACER

CROSS REFERENCE TO RELATED APPLICATIONS

The present application claims the benefit of U.S. Provisional Patent Application Ser. No. 61/817,279, filed Apr. 29, 2013, which is incorporated herein by reference in its entirety.

BACKGROUND

Embodiments of the present invention generally relate to latches for door locks. More particularly, embodiments of the present invention relate to spacers for door latches that are mounted in hollow core doors.

Latches for door locks often have a latch faceplate that can be rotated relative to a latch housing in order to align the latch faceplate with a bevel angle on an edge of the door. During installation of the door latch, such rotational displacement is typically insufficient to cause the latch to become disengaged from the lock chassis. However, when installed, and without sufficient support, the latch housing can be displaced in a manner that causes the latch to disengage from the lock chassis. For example, when placed in at least certain types of hollow doors, including, for example, hollow doors that do not include internal latch brackets, the movement of the door and/or the operation of the door lock may cause, at least initially, relatively gradual displacement, including rotational displacement, of the latch housing relative to the latch faceplate. Over time, such gradual displacement may translate into the latch becoming disengaged from the lock chassis, thereby interfering with the proper operation of the door lock.

BRIEF SUMMARY

An aspect of the present invention is a latch spacer for use with a latch housing of a latch assembly in a hollow inner region of a door. The latch spacer includes a plurality of sidewalls, at least a portion of the plurality of sidewalls being arranged to provide an outer perimeter. The latch spacer also includes an inner wall that is attached to at least a portion of the plurality of sidewalls by at least one inner rib. Additionally, the inner wall generally defines an opening that is adapted to receive placement of at least a portion of the latch housing. The latch housing also includes at least one crush rib that extends from each of at least two sidewalls of the plurality of sidewalls.

Another aspect of the present invention is an apparatus for a lock for a door that includes a latch assembly having a latch housing and a latch bolt. The latch bolt is adapted to be displaced at least partially within the latch housing between a first position and a second position. The apparatus also includes a latch spacer having a first pair of opposing sidewalls, a second pair of opposing sidewalls, and an inner wall. The inner wall defines an opening that is configured to receive the placement of at least a portion of the latch housing. The first and second pairs of opposing sidewalls generally define an outer perimeter of the latch spacer. Additionally, the first pair of opposing sidewalls is adapted to flex slightly when the second pair of opposing sidewalls abuts against inner surfaces of the door.

Another aspect of the present invention is an apparatus having a door having an inner region that is positioned between a pair of opposing sidewalls of the door. The apparatus also includes a latch assembly that has a latch housing and a latch bolt. The latch bolt is adapted to be displaced at least partially within the latch housing between a first position and a second position. The latch assembly is adapted for installation into the inner region of the door. Additionally, the apparatus includes a latch spacer having, a plurality of sidewalls and an inner wall. The inner wall defines an opening that is configured to receive the placement of at least a portion of the latch housing. The latch spacer is configured for a friction fit within the inner region by the engagement of at least a portion of the plurality of sidewalls of the latch spacer and the pair of opposing sidewalls of the door.

Other aspects of the present invention will become apparent by consideration of the detailed description and accompanying drawings.

Figure 1:
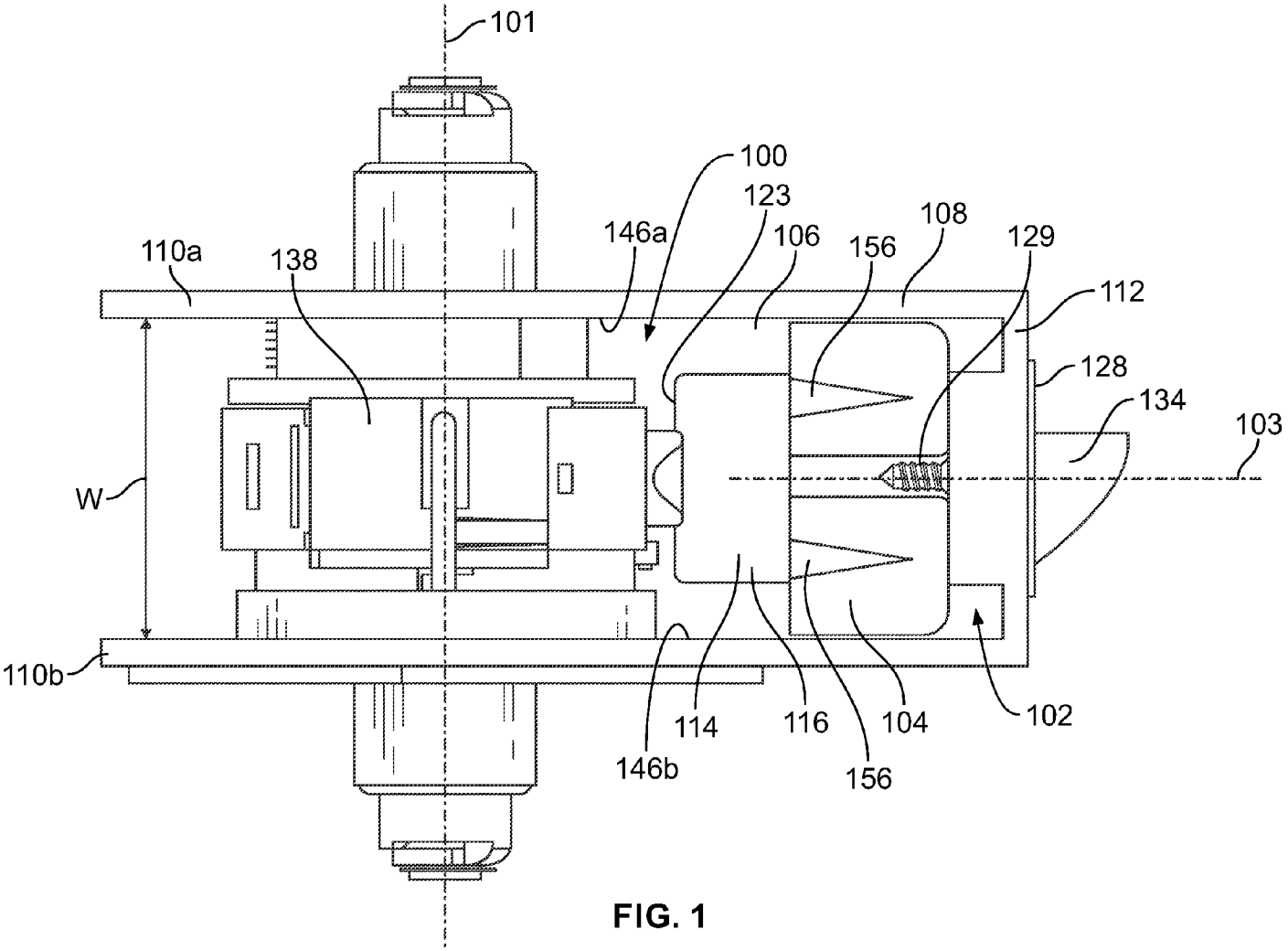
FIG. 1 illustrates a top view of a door lock assembly operably connected to a latch assembly and a latch spacer and positioned within an unreinforced hollow inner region of a door according to an illustrated embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

FIG. 1 illustrates a top view of a door lock assembly 100 operably connected to a latch assembly 102 and a latch spacer 104 and positioned within an unreinforced hollow inner region 106 of a door 108 according to an illustrated embodiment of the present invention. The door 108 may be constructed from a variety of different materials, such as, for example, wood or metal, including, but not limited to, aluminum or steel. In the illustrated embodiment, the door 108 includes at least two opposing sidewalls 110*a*, 110*b*, a first end wall 112, and a second end wall (not shown) that generally define at least a portion of the hollow, inner region 106 of the door 108.

The door lock assembly 100 and latch assembly 102 may generally be of any variety known in the art. In the illustrated embodiment, the door lock assembly 100 has a lock assembly central axis 101 that extends through and is generally orthogonal to the opposing sidewalls 110*a*, 110*b*, and is generally parallel to at least the first end wall 112. Additionally, a latch assembly central axis 103 of the latch assembly 102 extends through and is generally orthogonal to the first end wall 112.

Figure 2:
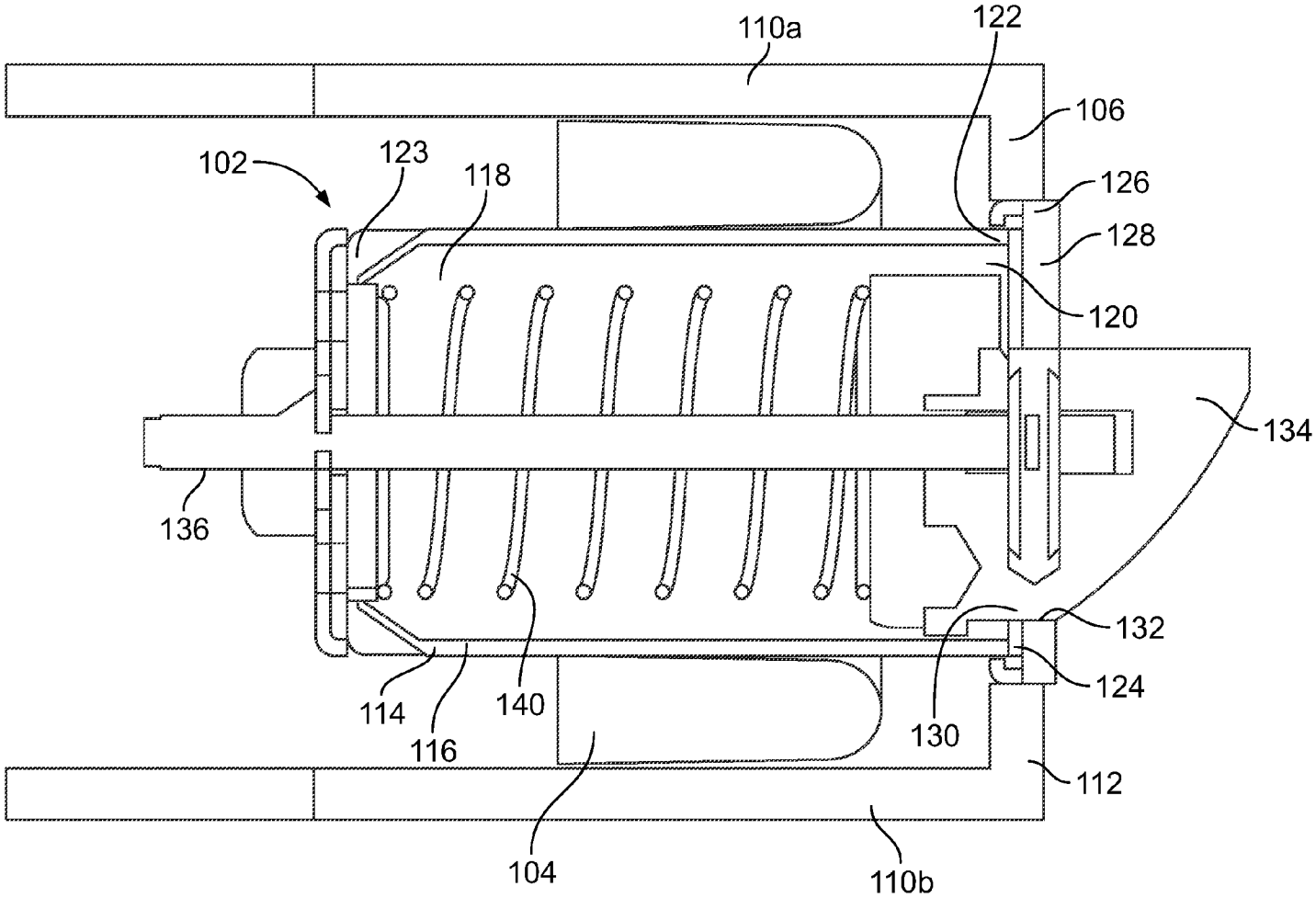
FIG. 2 illustrates a top sectional view of the latch assembly and the latch spacer shown in FIG. 1.
Figure 3:
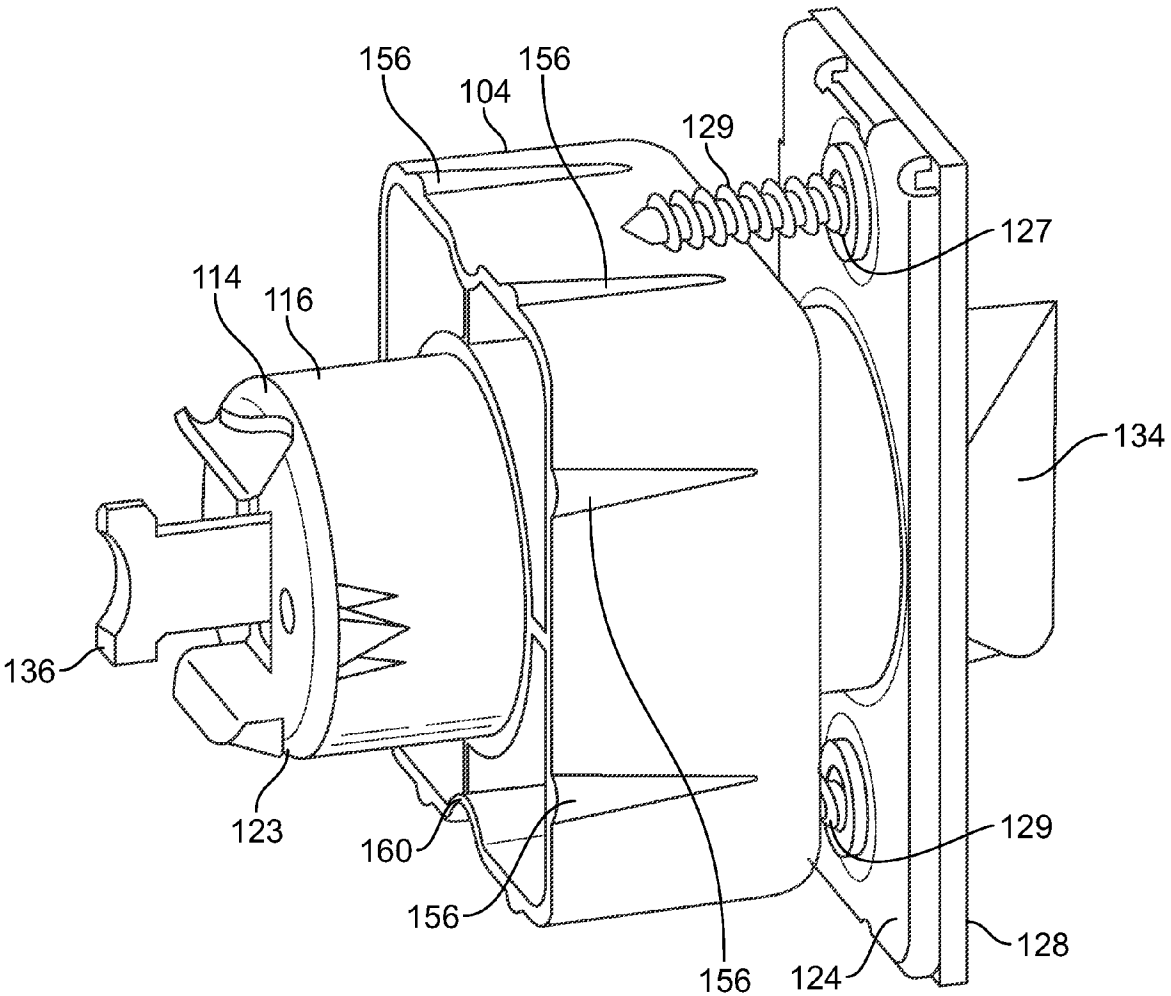
FIG. 3 illustrates a rear perspective view of the latch spacer and the latch assembly according to an illustrated embodiment of the present invention.
Figure 5:
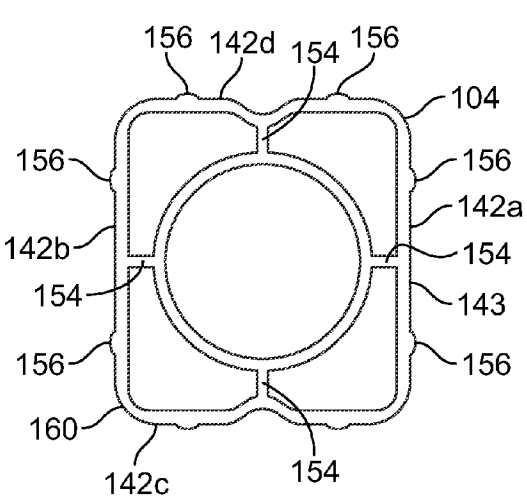
FIGS. 4 and 5 illustrate front and rear views, respectively, of the latch spacer according to an illustrated embodiment of the present invention.
Figure 7:
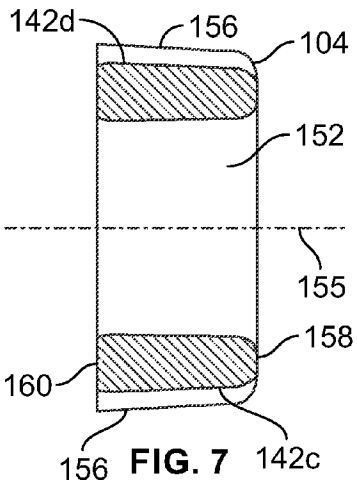
FIG. 7 illustrates a cross sectional view of the latch spacer according to an illustrated embodiment of the present invention as taken along line A-A in FIG. 4.
Figure 4:
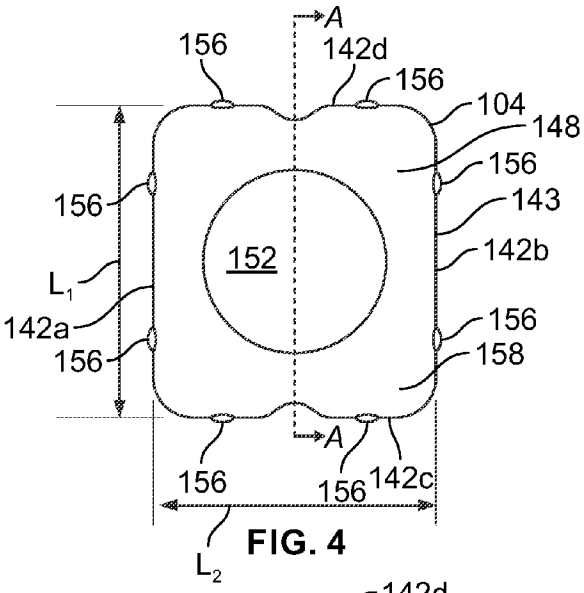
Figure 6:
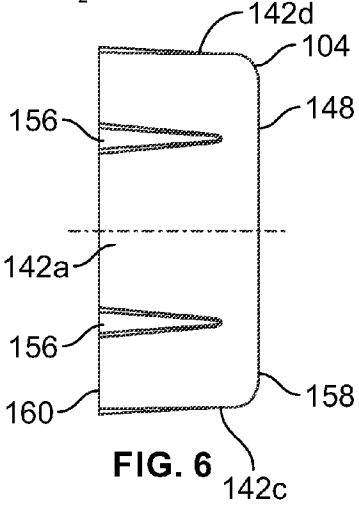
FIG. 6 illustrates a side view of the latch spacer according to an illustrated embodiment of the present invention.
Figure 9:
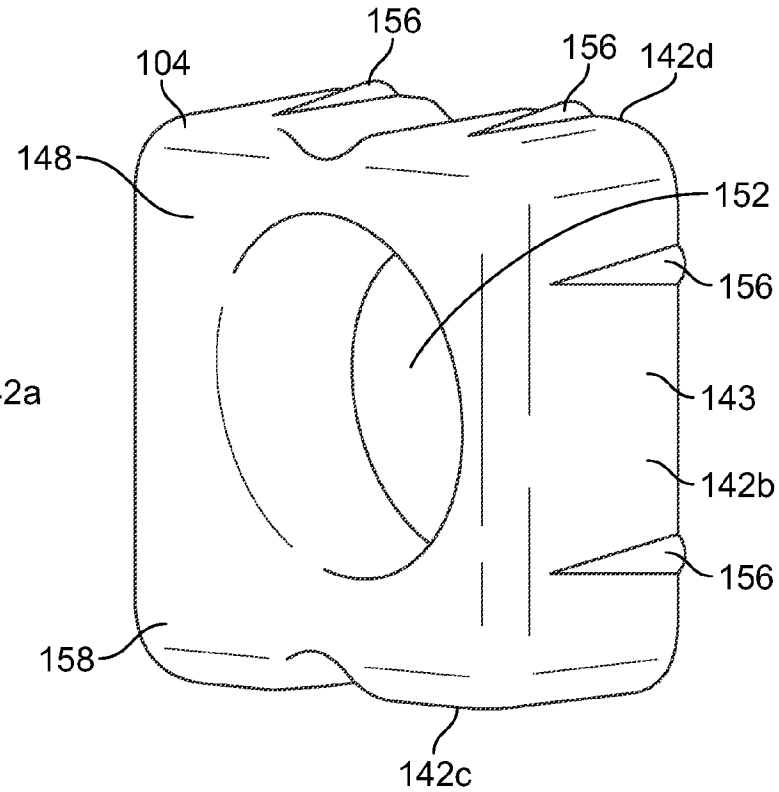
FIGS. 8 and 9 illustrate front and rear side perspective views, respectively, of the latch spacer according to an illustrated embodiment of the present invention.
Figure 8:
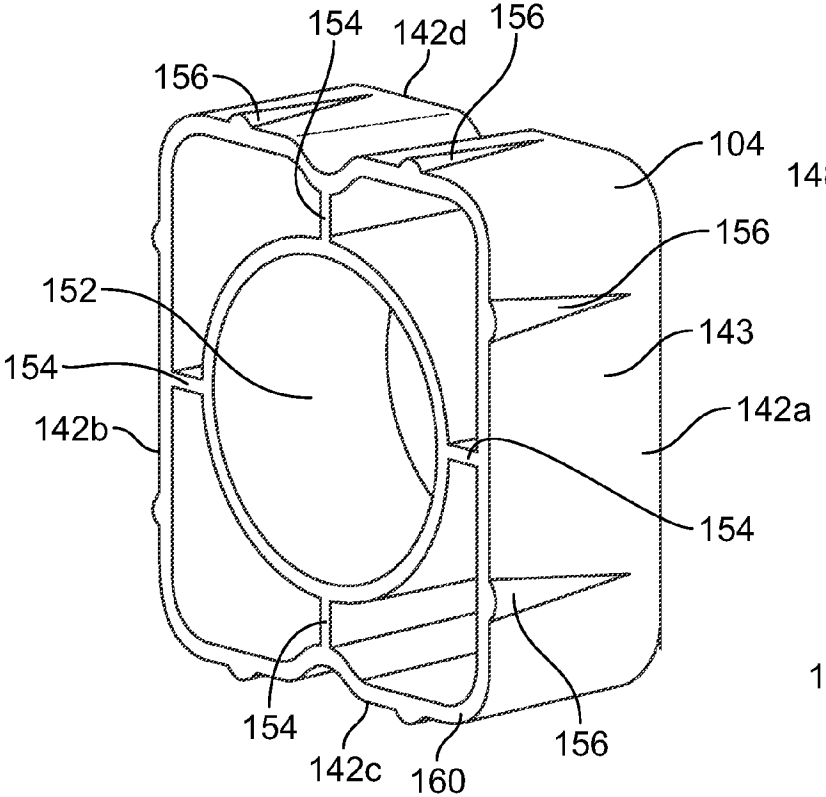

As shown in at least FIGS. 1-3, according to certain embodiments, the latch assembly 102 may include latch housing 114 having a sidewall 116 that generally defines an inner region 118 of the latch housing 114. An opening 120 positioned at a first end 122 of the latch housing 114 is generally covered by a latch back plate 124. The latch back plate 124 may be configured to fit within a recess 126 in, and/or abut on one side against a portion of the first end wall 112 of the door 106. Additionally, another side of the latch back plate 124 may abut against a latch faceplate 128. The latch back plate 124 and the latch faceplate 128 may both include apertures 127 that are configured to receive the insertion of a fastener 129, such as, of example, a screw, that secures the latch back plate 124 and the latch faceplate 128 to the door 108.

Additionally, the latch back plate 124 and the latch faceplate 128 may each include an orifice 130, 132 that is configured to accept the slideable displacement of a latch bolt 134 between a first position in which the latch bolt 134 does not prevent the opening or closing of the door 108, and a second position in which the latch bolt 134 extends into a mating recess adjacent to the door 108, such as, for example, in a door frame (not shown). During, such displacement, at least a portion of the latch bolt 134 may also be displaced within the inner region 118 of the latch housing 114.

The latch bolt 134 may be operably connected to a linkage mechanism 136 that extends from a second end 123 of the latch housing 114 and is also operably connected to the lock chassis or cylinder 138 of the door lock assembly 100. According to certain embodiments, the rotational displacement of the lock chassis 138, such as, for example, by the turning of a knob, handle, or lever by a user may at least linearly displace the linkage mechanism 136, which may displace the latch bolt 134 from the second position to the first portion. Upon removal of the force that caused rotational displacement of the lock chassis 138, a biasing force of a biasing member 140, such as, for example, a spring in the inner region 118 of the latch housing 114, may displace the latch bolt 134 back from the first position to the second position.

FIGS. 4-9 illustrate an example embodiment of a latch spacer 104. The latch spacer 104 may be installed in the inner region 106 of the door 108 before or after the latch assembly 102 is installed in the door 108. Further, the latch spacer 104 is configured to reduce or prevent lateral movement and pivoting of the latch assembly 102 within the inner region 106 of the door 108. Accordingly, the latch spacer 104 may at least assist in securing the latch assembly 102 in the inner region 106, including, for example, by assisting in retaining the attachment of the latch assembly 102 to the latch base plate 124 and the latch faceplate 128 and/or to the door lock assembly 100. Lateral movement is considered movement or translation to or from a door sidewall 110*a*, 110*b* in a direction generally perpendicular to the door sidewalls 110*a*, 110*b*. Lateral pivoting is considered movement in which the latch assembly 102 pivots or rotates about an axis that is generally parallel to the door sidewalls 110*a*, 110*b*.

The latch spacer 104 may be constructed from a variety of different materials. In certain embodiments, the latch spacer 104 is manufactured of a plastic material that, along with the geometry of the latch spacer 104, provides enough flexibility to fit within the inner region 106 of the door 108 while maintaining sufficient rigidity to frictionally fit within the inner region 106, and remain installed in the inner region 106, including when the latch assembly 102 and/or door 108 is/are subjected to a load or force during use and/or when subjected to impact forces. According to certain embodiments, the latch spacer 104 is an infection-molded, fire resistant, plastic. Possible materials for the latch spacer 104 include VALOX™ 375U and VALOX™ 375, among other materials. However, the latch spacer 104 may be manufactured according to other methods, such as extrusion, casting, or forging. Additionally, according to certain embodiments, the latch spacer 104 is manufactured from a metal, such as, for example, zinc, steel or aluminum, or a foam material, such as polystyrene, among other materials.

In the illustrated embodiment, the latch spacer 104 includes a plurality of sidewalls 142*a-d* that forms an outer perimeter 143 of the latch spacer 104. The outer perimeter 143 may have a variety of different shapes and sizes, such as, for example, being square, rectangular, circular, and non-circular. Further, according to certain embodiments, at least a portion of the outer perimeter 143 is configured to engage an inner surface 146*a*, 146*b* of the sidewalls 110*a*, 110*b* of the door 108 when the latch spacer 104 is operably positioned within the inner region 106 of the door 108. For example, according to certain embodiments, the outer perimeter 143 may have a generally rectangular shape such that at least one pair of opposing sidewalls 142*a*. 142*b* has a first length, as indicated by $L_1$ in FIG. 4, that is different than a second length ($L_2$) of another pair of opposing walls 142*c*, 142*d*. As discussed below, such differences in length ($L_1$, $L_2$) may provide the spacer 104 with different thicknesses so that the latch spacer 104 may be positioned in multiple orientations to allow a single latch spacer 104 to accommodate different door thicknesses.

At least a portion of the sidewalls 142*a-d* that forms the outer perimeter 143 includes one or more crush ribs 156. In the illustrated embodiment, each spacer sidewall 142*a-d* that forms the outer perimeter 143 includes two crush ribs 156. However, in other embodiments, one or more of the sidewalls 142*a-d* may not include any crush ribs 156, or may include more or fewer crush ribs 156. The crush ribs 156 may be compressed, deformed, bent, and/or shaved by the operable engagement with the inner surfaces 146*a*, 146*b* of the sidewalls 110*a*, 110*b* of the door 108 so that the latch spacer 104 may be reduced in thickness, if necessary, to accommodate the width of the inner region 106 of the door 108.

Further, according to certain embodiments, at least one sidewall 142*e* may provide an end wall 148 that extends between and/or connects, at least some of the other sidewalls 142*a-d*. Further, according to certain embodiments, the end wall 148 may provide rigidity or stiffness to the latch spacer 104. According to the illustrated embodiment, when the latch spacer 104 is installed in the inner region 106 of the door 108, the end wall 148 of the latch spacer 104 is generally parallel to, but does not necessarily contact, the first end wall 112 of the door 108.

The latch spacer 104 may also include an inner wall 150 that defines an opening 152 that is generally centrally located through the latch spacer 104. For example, according to certain embodiments, the opening 152 may have a central axis 155 (FIG. 7) that, when the latch spacer 104 is operably positioned in the inner region 106 with the latch assembly 102, is generally aligned with the latch assembly central axis 103. The opening 152 is configured to receive the insertion of at least a portion of the sidewall 116 of the latch housing 114 such that at least a portion of the inner wall 150 is in contact with the latch housing 114. Moreover, the opening 152 is sized for the latch spacer 104 to be slideable along at least a portion of the sidewall 116 of the latch housing 114 so that the latch spacer 104 may be positioned between the latch housing 114 and the inner surface 146*a*, 146*b* of the adjacent sidewall 110*a*, 110*b* of the door 108. Thus, according to certain embodiments, the opening 152 may extend through the end wall. 148 of the latch spacer 104. In the illustrated embodiment, the inner wall 150 defines an opening 152 having a circular cross-section, although other cross-sections of the opening 152 are contemplated.

The inner wall 150 may be connected to the sidewalls 142*a-d* by inner ribs 154 that are configured to support at least a portion of the inner wall 150. As shown by at least FIGS. 5 and 8, according to the illustrated embodiment, the inner rib 154 may be a relatively thin strip of material that is separated from other inner ribs 154 by spaces. Further, the inner ribs. 154 are configured to stiffen the latch spacer 104 so that, during installation, the latch spacer 104 may be generally centered between opposing, adjacent inner surfaces 146*a*, 146*b* of the sidewalls 110*a*, 110*b* of the door 108.

Additionally, in certain embodiments, the sidewalls 142*a-d* of the latch spacer 104 may each be substantially parallel to the central axis 155 of the opening 152 of the latch spacer 104. In other embodiments, one or more of the sidewalls 142*a-d* may be at an oblique angle to the central axis 155 of the opening 152, such that a width of the first end 158 of the latch spacer 104 is less than the corresponding width at the opposite second end 160 of the latch spacer 104, as shown for example in FIG. 7. According to such embodiments, the sidewalls 142*a-d* that form the outer perimeter 143 may have a generally tapered configuration in which the distance from the sidewall 142*a-d* to the central axis 155 increases as the sidewalls 142*a-d* extend toward the second end 160 of the latch spacer 104. In these and other embodiments, the crush ribs 156 may protrude from the sidewalls 142*a-d* by a greater distance at the second end 160 of the latch spacer 104 than at the first end 158. Such a tapered configuration of the sidewalls 142*a-d* may improve the ease of installing the latch spacer 104 in the inner region 106 of the door 108, as well as the ease at which the latch spacer 104 may be removed from a mold during manufacturing.

In certain embodiments, the overall width of the latch spacer 104, including the crush ribs 156, before the latch spacer 104 is installed into the door 108 is slightly greater than the width of the inner region 106 between opposing inner surfaces 146*a*, 146*b* of the door 108, as indicated by (W) in FIG. 1. In such embodiments, when the latch spacer 104 is installed, the crush ribs 156 may accommodate some variance between the width of the inner region 106 of the door 108 and the width of the latch spacer 104. More specifically, as previously discussed, during installation, the crush ribs 156 may deform to accommodate the width of the inner region 106. Furthermore, during installation of the latch spacer 104, the sidewalk 110*a*, 110*b* may shave off a portion of the crush ribs 156 as the latch spacer 104 is moved into position within the inner region 106 such that a tight fit, such as, for example, a friction fit, between the latch spacer 104 and the opposing sidewalls 110*a*, 110*b* of the door 108 is achieved.

Figure 10:
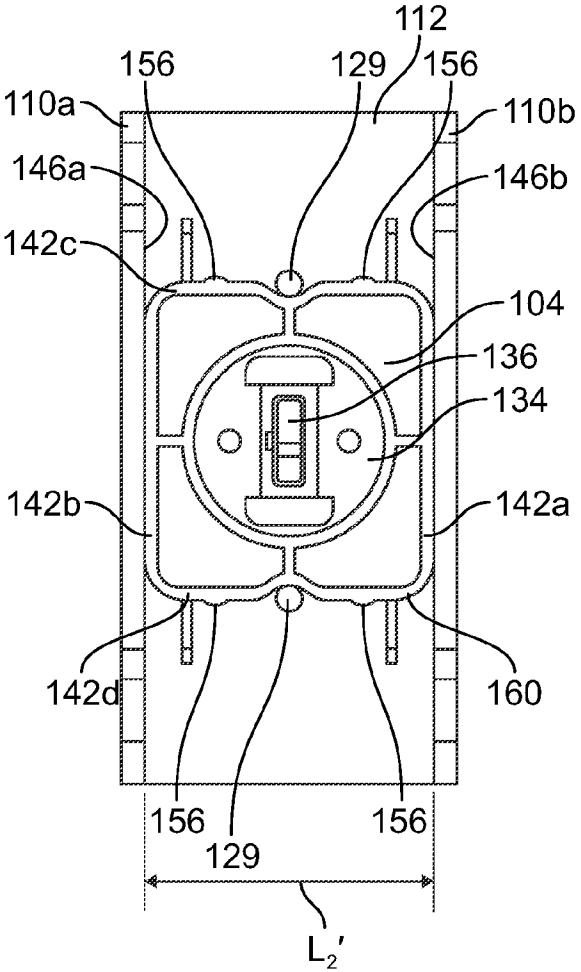

Additionally, the latch spacer 104 may be configured such that, when the latch spacer 104 is installed in the inner region 106, the differences in widths between the latch spacer 104 and the inner region 106 may cause at least the sidewalls 142*a-d* of the latch spacer 104 that span across the width of the inner region 106, such as, for example, sidewalls 142*c*, 142*d* in FIG. 10, to flex slightly to both provide a close fit between the latch spacer 104 and the sidewalls 110*a*, 110*b* and to establish a frictional force sufficient to hold the latch spacer 104 at a proper orientation within the inner region 106 of the door 108. Similarly, during installation, the inner ribs 154 that extend between the inner wall 150 of the latch spacer 104 and the sidewalls 142*a-d* of the latch spacer 104 that are abutted against the sidewalls 110*a*, 110*b* of the door 108, such as, for example, sidewalls 142*a*, 142*b* in FIG. 10, may also flex slightly so that the latch spacer 104 may fit within the confines of the inner region 106 while also providing sufficient rigidity to maintain the latch spacer 104 in a relatively tight engagement with the sidewalk 110*a*, 110*b* of the door 108.

Figure 11:
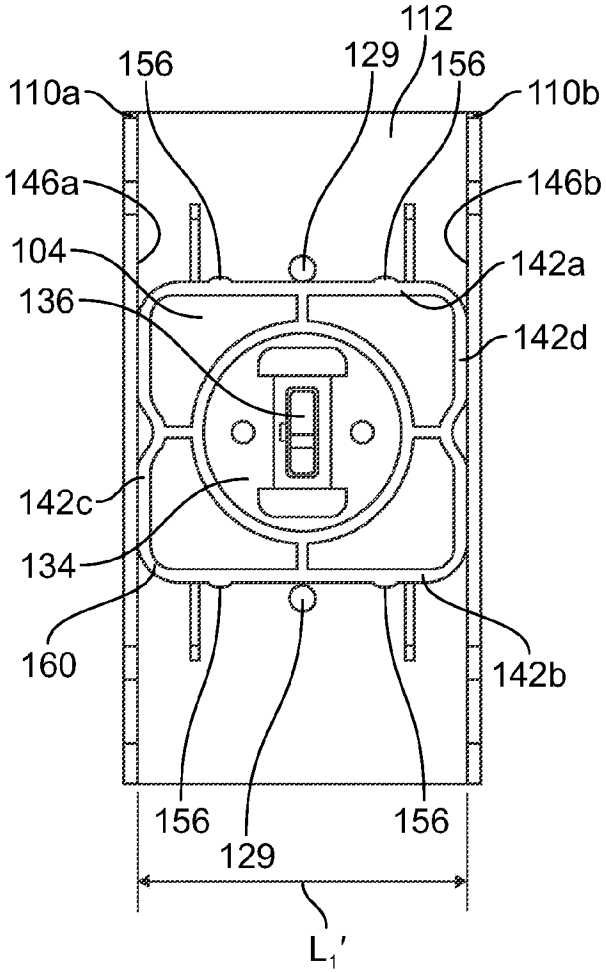
FIGS. 10 and 11 illustrate the latch spacer according to an illustrated embodiment of the present invention in a first orientation and a second orientation, respectively.

As illustrated in FIGS. 10 and 11, the latch spacer 104 may be dimensioned such that the same latch spacer 104 can be installed in doors 108 of different widths, depending on the orientation in which the latch spacer 104 is installed. Moreover, the width(s) of the outer perimeter 143 may allow the latch spacer 104 to be installed in multiple different orientations to accommodate different door thicknesses. For example, in the illustrated embodiment, as discussed above with respect to the example latch spacer 104 shown in FIG. 4, a first pair of opposing sidewalk 142*a*, 142 may have a length ($L_1$) that is larger than the length ($L_2$) of another, second pair of opposing sidewalls 142*c*, 142*d*. Thus, for doors 108 having a narrower width, the latch spacer 104 may be in a first orientation in which the longer first pair of sidewalls 142*a*, 142*h* abuts against the inner surfaces 146*a*, 146*b* of the sidewalk 110*a*, 110*b* of the door 108. Moreover, when in the first orientation, the latch spacer 104 is oriented such that the shorter, second pair of sidewalk 142*c*, 142*d* span across the relatively narrower width of the inner region 106, such as, for example by the length $L_2'$. In the illustrated embodiment, the length $L_2'$ may be the length or width of the latch spacer 104 in a narrower of two possible orientations after the original length $L_2$ (FIG. 4) has been adjusted to accommodate for thickness of the inner region 106, such as, for example, via shaving and/or compression of at least some crushed ribs 156 and/or flexing in sidewalls 142*c*, 142*d* or at least some of the inner ribs 154, and which thereby may allow for a friction fit of the latch spacer 104 in the inner region 106 of the door 108.

Conversely, for larger width doors 108, the latch spacer 104 may be positioned in a second, wider, orientation, as shown in FIG. 11, in which the longer first pair of opposing sidewalls 142*a*, 142*b* span across the inner region 106 of the door 108. In the illustrated embodiment, for example, the latch spacer 104 may span across the relatively wider width of the inner region 106 by latch spacer length of $L_1'$, which may, depending on differences in sizes, may be smaller than the length $L_1$ shown in FIG. 4 due to shaving and/or compression of at least some crushed ribs 156 and/or flexing in sidewalls 142*a*, 142*b* or at least some of the inner ribs 154, and which thereby may allow for a friction fit of the latch spacer 104 in the inner region 106 of the door 108.

According to certain embodiments, one or more opposing sidewalls 142*a-d* that form the outer perimeter 143 may include one or more notches 158 that are shaped to provide a clearance that prevents the sidewalls 142*a-d* from interfering with fasteners 129 that are installed to secure at least the latch back plate 124 and the latch faceplate 128 to the door 108 and/or to the latch assembly 102. For example, comparing FIGS. 10 and 11, when the latch spacer 104 is in the first position (FIG. 10), the longer length of the first pair of opposing sidewalls 142*a*, 142*b* cause the second pair of opposing sidewalls 142*c*, 142*d* to be in relatively close proximity to a pathway of the fastener 129. Accordingly, the second pair of opposing sidewalls 142*c*, 142*d* each includes a notch 158 that prevents those sidewalls 142*c*, 142*d* from interfering with the installation of the fasteners 129. However, as shown by FIG. 11, when the latch spacer 104 is in the second orientation, in the illustrated embodiment, the shorter second pair of opposing sidewalls 142*c*, 142*d* are not long enough to present issues with the first pair of opposing sidewalls 142*a*, 142*b* interfering with the installation of the fasteners 129. Accordingly, in this embodiment, the first pair of opposing sidewalls 142*a*, 142*b* may not include the notches 158. It is appreciated that the latch spacer 104 may accommodate these fasteners 129 in a variety of other manners, including, for example, by the use of through-holes or other openings in the latch spacer 104. For example, according to certain embodiments, the notches 158 may be threaded openings that mate with the threads of the fasteners 129 such that the latch spacer 104 may be held in place by the fasteners 129.

Additionally, the notches 158 may be positioned and/or configured to provide visible or tactile indication of the orientation of the latch spacer 104 before or after the latch spacer 104 is positioned within the inner region 106. The visual or tactile orientation indication provided by the notches 158 may assist an installer with orienting the latch spacer 104 within the door 108 both before and during installation of the latch assembly 102.

It is also contemplated that the overall width of the latch spacer 104 may be less than the width of the interior region 106 between the inner surfaces 146*a*, 146*b* of the sidewalls 110*a*, 110*b* of the door 108. In such a case, the latch spacer 104 may not contact the sidewalls 110*a*, 110*b* of the door 108. In these and other embodiments, the latch spacer 104 may not be mounted in the door 108 by a frictional fit, but rather by a mounting apparatus. By way of non-limiting example, the latch spacer 104 may be secured to the door 108 by mechanical fasteners, including, for example, the fasteners 129 used in mounting the latch faceplate 128 to the first end wall 112 of the door 108.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A latch spacer for use with a latch housing of a latch assembly in a hollow inner region of a door, the latch spacer comprising:

a plurality of sidewalls, at least a portion of the plurality of sidewalls arranged to provide an outer perimeter, each of the plurality of sidewalls having an inner surface, the inner surface and the outer perimeter being on opposing sides of the plurality of sidewalls;

an inner wall attached to at least a portion of the plurality of sidewalls by at least one inner rib, the at least one inner rib extending between the inner surface of the plurality of sidewalls and the inner wall, the inner wall generally defining an opening, the opening adapted to receive placement of at least a portion of the latch housing; and at least one crush rib extending from the outer perimeter of each of at least two sidewalls of the plurality of sidewalls, the at least one crush rib and the at least one inner rib each having a shape that is adjustable to adjust a width of the latch spacer to fit within a width of the hollow inner region in manner that prevents at least one of lateral movement and lateral rotation of the latch spacer within the hollow inner region of the door.

2. The latch spacer of claim 1, wherein the plurality of sidewalls comprises a first pair of opposing sidewalls and a second pair of opposing sidewalls, the first pair of opposing sidewalls having a first length that is larger than a second length of the second pair of opposing sidewalls.

3. The latch spacer of claim 2, wherein the first and second pairs of opposing sidewalls are arrange at an oblique angle to a center axis of the opening.

4. The latch spacer of claim 2, wherein each sidewall of the first and second pairs of opposing sidewalls include at least two crush ribs.

5. The latch spacer of claim 4, wherein the first pair of opposing sidewalls are configured to flex slightly when the second pair of opposing sidewalls abut against inner surfaces of the door.

6. The latch spacer of claim 4, wherein at least one of the first and second pairs of opposing sidewalls includes at least one notch configured to at least accommodate the installation of a fastener of the latch assembly.

7. The latch spacer of claim 6, wherein the at least one notch is configured to provide a tactile indication of the orientation of the latch spacer when the latch spacer is positioned within the inner region of the door.

8. An apparatus for a lock for a door comprising:

a latch assembly having a latch housing and a latch bolt, the latch bolt adapted to be displaced at least partially within the latch housing between a first position and a second position; and a latch spacer having a first pair of opposing sidewalls, a second pair of opposing sidewalls, and an inner wall, the inner wall coupled to at least one of the first and second pairs of opposing sidewalls by one or more inner ribs, the inner wall defining an opening, the opening being configured to receive the placement of at least a portion of the latch housing, the first and second pairs of opposing sidewalls generally defining an outer perimeter of the latch spacer, the first pair of opposing sidewalls adapted to flex slightly when the second pair of opposing sidewalls abut against inner surfaces of the door in manner that adjusts a width of the latch spacer to conform to a width of a hollow inner region of the door in manner that prevents at least one of lateral movement and lateral rotation of the latch spacer within the hollow inner region of the door.

9. The apparatus of claim 8, further including at least one crush rib extending from the outer perimeter and positioned on each sidewall of the first and second pairs of opposing sidewalls, the at least one crush rib having a shape that is deformable when the at least one crush rib abuts against the inner surface of the door when the latch spacer is positioned in the hollow inner region.

10. The apparatus of claim 9, wherein each sidewall of the first and second pairs of opposing sidewalls is connected to the inner wall by an inner rib.

11. The apparatus of claim 10, wherein the first pair of opposing sidewalls have a first length that is larger than a second length of the second pair of opposing sidewalls.

12. The apparatus of claim 10, wherein at least one of the first and second pairs of opposing sidewalls includes at least one notch that is configured to at least accommodate the installation of a fastener of the latch assembly.

13. An apparatus comprising:

a door having an inner region positioned between a pair of opposing sidewalls of the door;

a latch assembly having a latch housing and a latch bolt, the latch bolt adapted to be displaced within at least a portion of the latch housing between a first position and a second position, the latch assembly adapted for installation into the inner region of the door; and a latch spacer having a plurality of sidewalls and an inner wall, the inner wall being attached to the plurality of sidewalls by at least one inner rib, the inner wall defining an opening configured to receive the placement of at least a portion of the latch housing, the latch spacer configured for a friction fit within the inner region by the engagement of at least a portion of the plurality of sidewalls of the latch spacer with the pair of opposing sidewalls of the door, the least one inner rib having a shape that is adjustable to adjust a width of the latch spacer to fit between the pair of opposing sidewalls of the door in a manner that prevents at least one of lateral movement and lateral rotation of the latch spacer in the inner region.

14. The apparatus of claim 13, wherein the plurality of sidewalls comprises a first pair of opposing sidewalls and a second pair of opposing sidewalls, the first pair of opposing sidewalls configured to provide the latch spacer with a first width, the second pair of opposing sidewalls configured to provide the latch spacer with a second width, the first width being larger than the second width.

15. The apparatus of claim 14, wherein the latch spacer is adapted to be operably positioned about at least a portion of the latch housing and in the inner region in either a first orientation or a second orientation, the first orientation having a first latch spacer width between the pair of opposing sidewalls of the door, the second orientation having a second latch spacer width between the pair of opposing sidewalls of the door, the first latch spacer width being smaller than the second latch spacer width.

16. The apparatus of claim 15, wherein at least one of the plurality of sidewalls of the latch spacer includes a crush rib, the crush rib having a shape that is deformable when the crush rib is abutted against a sidewall of the pair of opposing sidewalls of the door to assist in the friction fitting of the latch spacer with the pair of opposing sidewalls.

17. The apparatus of claim 16, wherein each sidewall of the second pair of opposing sidewalls includes a notch that provides at least clearance for a fastener of the latch assembly.

18. The apparatus of claim 17, wherein the first pair of opposing sidewalls are configured to flex slightly when the second pair of opposing sidewalls abut against the pair of opposing sidewalls of the door.

19. The apparatus of claim 18, wherein each of the plurality of sidewalls are connected to the inner wall by one or more of the at least one inner rib.

20. The apparatus of claim 19, wherein the plurality of sidewalls are arrange at an oblique angle to a center axis of the opening.

* * * * *